US005570092A

United States Patent [19]

Kohin-Nitschelm

[11] Patent Number: 5,570,092

[45] Date of Patent: Oct. 29, 1996

[54] REDUCTION OF SCATTER FROM MATERIAL DISCONTINUITIES

[75] Inventor: Margaret Kohin-Nitschelm, North Billerica, Mass.

[73] Assignee: Hughes Danbury Optical Systems, Inc., Danbury, Conn.

[21] Appl. No.: 225,745

[22] Filed: Apr. 11, 1994

[51] Int. Cl.[6] ..... H01Q 17/00

[52] U.S. Cl. ..... 342/1

[58] Field of Search ..... 392/1, 2, 3, 4

[56] References Cited

U.S. PATENT DOCUMENTS 4,118,704 10/1978 Ishino et al. ..... 342/1

OTHER PUBLICATIONS

Rojas, Roberto G., "Wiener–Hopf Analysis of the EM Diffraction by an Impedance Discontinuity in a Planar Surface and by an Impedance Half–Plane," *IEEE Transactions on Antennas and Propagation,* 36(1): 71–83 (1988).

Maliuzhinets, G. D., "Excitation, Reflection and Emission of Surface Waves from a Wedge with Given Face Impedances," Acoustics Institute, Academy of Sciences, USSR, 752–755.

Rojas, Roberto G., "Electromagnetic Diffraction of an Obliquely Incident Plane Wave Field by a Wedge with Impedance Faces," *IEEE Transactions on Antennas and Propagation,* 36(7): 956–970 (1988).

*Primary Examiner*—Daniel T. Pihulic
*Attorney, Agent, or Firm*—W. C. Schubert; W. K. Denson-Low

[57] ABSTRACT

A method and apparatus for reducing electromagnetic scatter is disclosed in which a step discontinuity is formed at the interface between two media having different surface impedances.

27 Claims, 5 Drawing Sheets

REDUCTION OF SCATTER FROM MATERIAL DISCONTINUITIES

BACKGROUND OF THE INVENTION

It is well known that electromagnetic (EM) radiation incident on the junction between two different materials will "scatter." Scatter, or diffraction of electromagnetic waves at material discontinuities results from phase and amplitude changes which occur in incident waves impinging at the interface between two media having different material properties. Scatter is a generally undesirable phenomena, since it is a source of both electromagnetic noise, which could interfere with transmission or reception of electromagnetic signals, and radar cross section, which reduces the detection range of low observable (LO) vehicles. Much research has been conducted into methods for avoiding detection by minimizing the Radar Cross-Section (RCS) of objects. One technique has been to form a smooth contoured exterior surface with few gaps or surface discontinuities. Quite often, this cannot be fully achieved. For example, in military vehicles, discontinuities occur inevitably at the interface between two different materials where two dissimilar parts of the vehicle meet, such as the interface between a radome and the vehicle skin, or a window and the vehicle skin, or a canopy and the vehicle skin.

SUMMARY OF THE INVENTION

In accordance with the present invention, scatter, caused by material discontinuities, is reduced. Such scatter occurs at the interface between media having different surface impedances caused by differences in the dielectric permitivities, magnetic permeabilities, and/or thicknesses of the two materials. Reduction in scatter is achieved by introducing a step discontinuity of the proper height at the interface between the media. This step discontinuity is formed over the medium with the smaller imaginary part of the surface impedance. The step of the discontinuity is filled with a material which, given the step height, causes the imaginary parts of the surface impedances of the media to be closely matched at the frequency, or over the frequency range, of the incident radiation.

DETAILED DESCRIPTION OF THE INVENTION

Figure 1A:
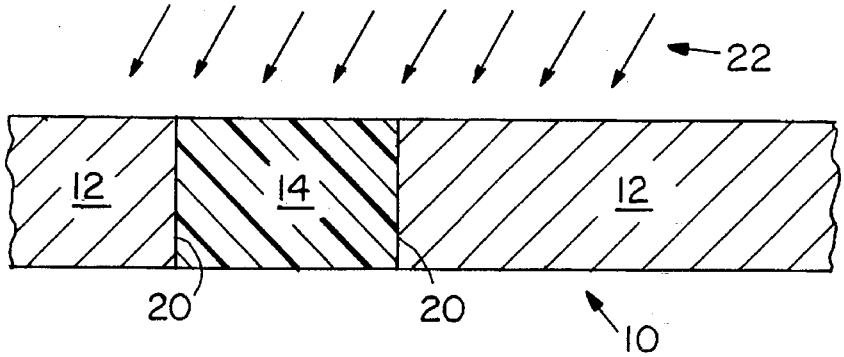
FIG. 1A PRIOR ART
FIG. 1A is a cross-sectional prior art view of a portion of an object in which scattering occurs due to the different surface impedances of materials 12 and 14.

The invention will now be described in detail with the assistance of FIGS. 1A–1C and FIGS. 2–5. Referring now to FIG. 1A (Prior Art), the figure shows a cross-sectional view of a portion of an object 10, having a surface impedance discontinuity. The portion consists of two dissimilar materials 12 and 14 joined at interfaces 20.

At the interface 20, a surface impedance discontinuity is present due to the difference in the dielectric permitivities, magnetic permeabilities, and/or thicknesses of the two media 12 and 14. Electromagnetic radiation impinging on the surfaces is scattered at the interfaces 20. The scatter from the interface between two materials can be estimated from the known surface impedances of two materials. (See for example:

G. D. Maliuzhinets, "Excitation, Reflection and Emission of Surface Waves from a Wedge with Given Face Impedances," *Soviet Phys. Dokl.*, Vol 3, pp 752–755, 1958; R. G. Rojas, "Wiener-Hopf Analysis of the EM Diffraction by an Impedance Discontinuity in a Planar Surface and by an Impedance Half-Plane," *IEEE Trans. on Antennas and Propagation*, Vol. AP-36, No. 1, pp. 71–83, January 1988; and R. G. Rojas, "Electromagnetic Diffraction of an Obliquely Incident Plane Wave Field by a Wedge with Impedance Faces," *IEEE Trans. on Antennas and Propagation*, Vol. AP-36, No. 7, pp. 956–970, July 1988.)

When the surface impedance difference between the two materials is zero, the back-scatter is approximately zero at all aspect angles, except normal incidence, where there is a specular return. Thus, if the difference between the surface impedances of the two materials is reduced, the scatter is reduced. The surface impedance of a bulk or multilayered material can be determined using standard thin film theory (H. A. Macleod, "Thin-Film Optical Filters," 2nd Edition, Macmillan Publishing Company, New York 1986).

Figure 1B:
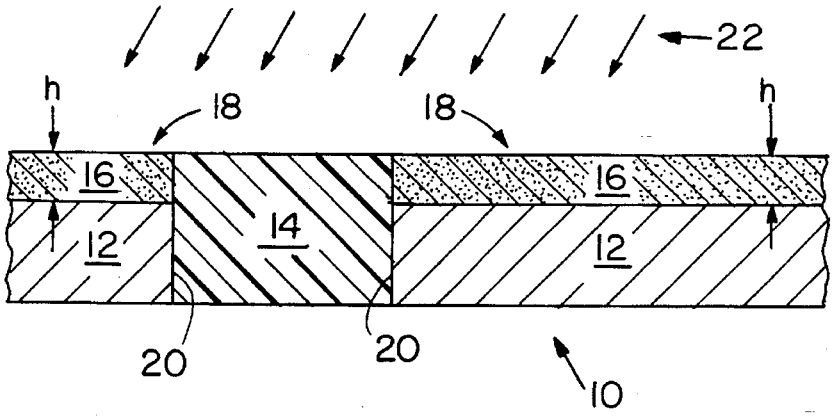
FIG. 1B is a cross-sectional view as in FIG. 1A illustrating the inventive concept in which a step discontinuity 18 is introduced and a layer of material 16 added to reduce scattering.

Referring now to FIG. 1B, an embodiment of the invention is illustrated therein in which a step discontinuity 18 is introduced at the interfaces 20 between the two dissimilar media 12 and 14. The step discontinuity is made by forming a step 18 in the media 12 having the lower surface impedance, or by predetermining the proper height difference between the two media in relation to the material to be used in the step to compensate for the surface discontinuity.

For example, a step filled with a dielectric or air over a single layer, non-transparent material will have a step height, h, that is approximately equal to;

$$h \cong \frac{\lambda}{2\pi n} \text{ Arctan}[n(Im\{Z \text{ desired}\} - Im\{Z \text{ original}\})]$$

where Z desired is the surface impedance of the material with the higher imaginary part of the surface impedance (material 14), Z original is the surface impedance of the material with the smaller imaginary part of the surface impedance (material 12), n is the refractive index of the dielectric filling, and $\lambda$ is the wavelength of the EM energy.

The step 18 may extend over the entire object or may be tapered away from each interface (not shown). The step is filled with a suitable material 16 to form a layer of material.

The material 16 is selected, along with the height of the step, to minimize the difference between the imaginary parts of the surface impedances of the two media at the frequency of the EM radiation. Alternately, as shown in FIG. 1C, with proper design, the step 18 may simply be a depression of height h' left void of material, except for a layer of air or vacuum (not labelled).

The thickness of the layer or height h/h' of the step, be it air or other materials, provided over the step discontinuity is determined so as to minimize the difference between the imaginary parts of the surface impedances of the materials 12 and 14.

Figure 1C:
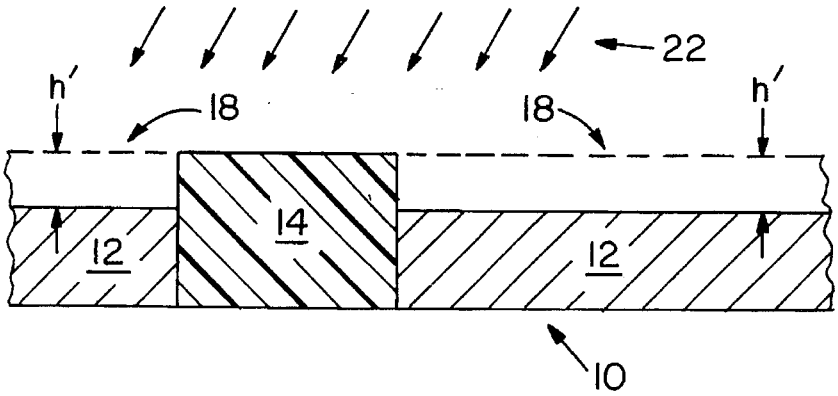
FIG. 1C is a view as in FIG. 1B where the layer of material is air.

For example, assume that in FIG. 1C, the materials 14 and 12 are respectively silicon and aluminum.

Figure 2:
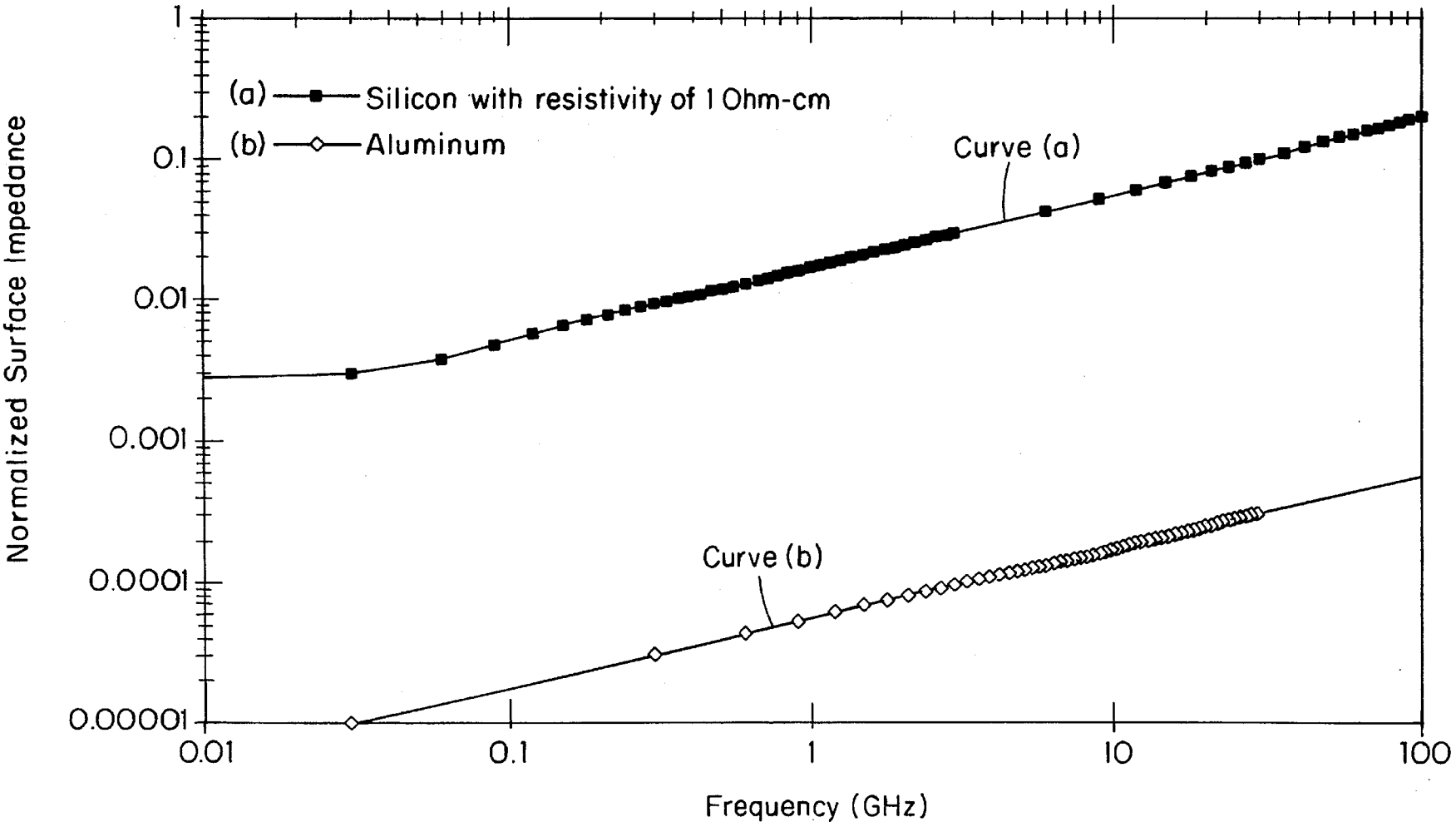
FIG. 2 is a plot of the real part of the impedance of a 0.4 inch thick conductive substrate of silicon (curve a) and aluminum (curve b) versus frequency.
Figure 3:
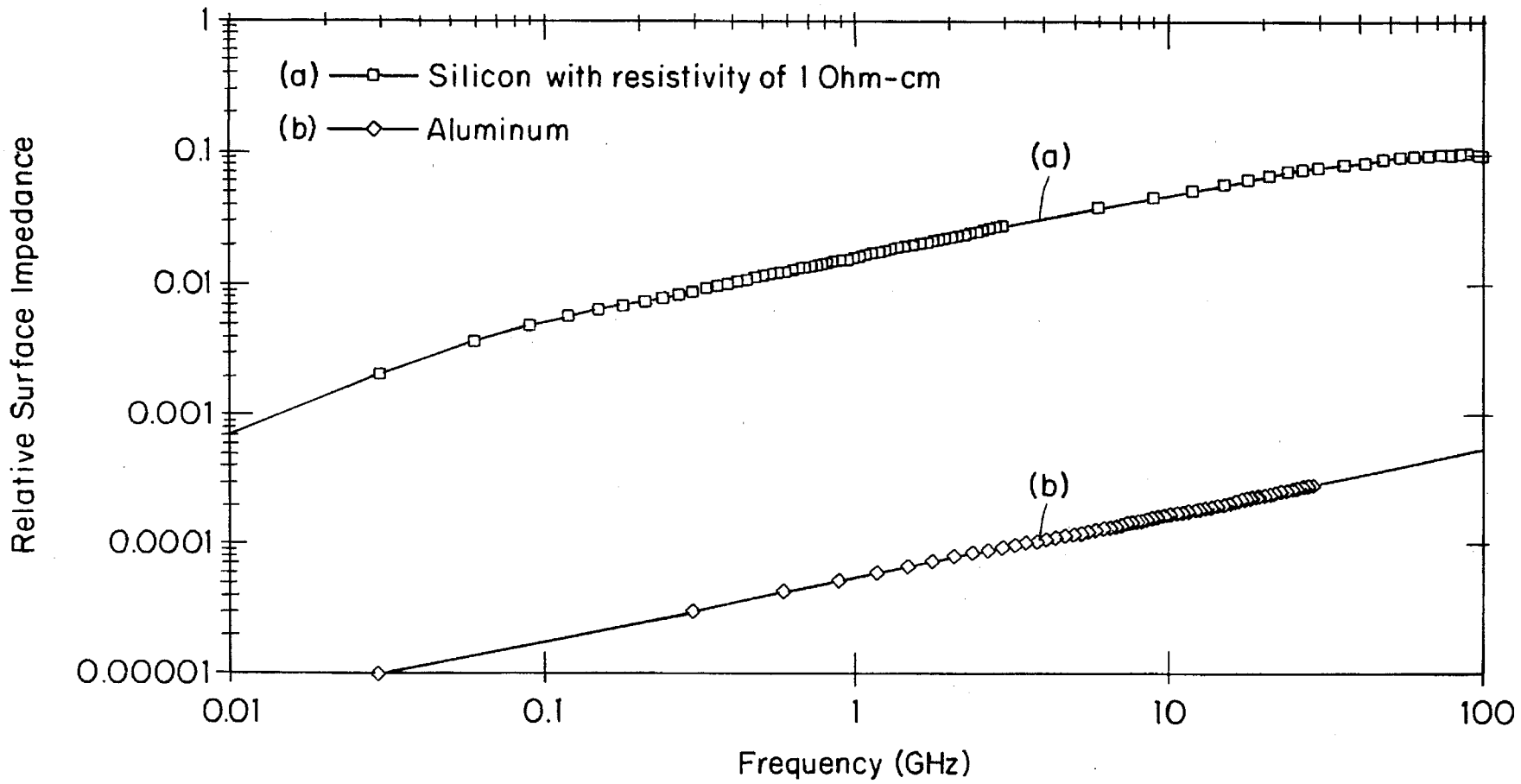
FIG. 3 is a plot of the imaginary part of the impedance of a 0.4 inch thick conductive substrate of silicon (curve a) and aluminum (curve b) versus frequency.
Figure 4:
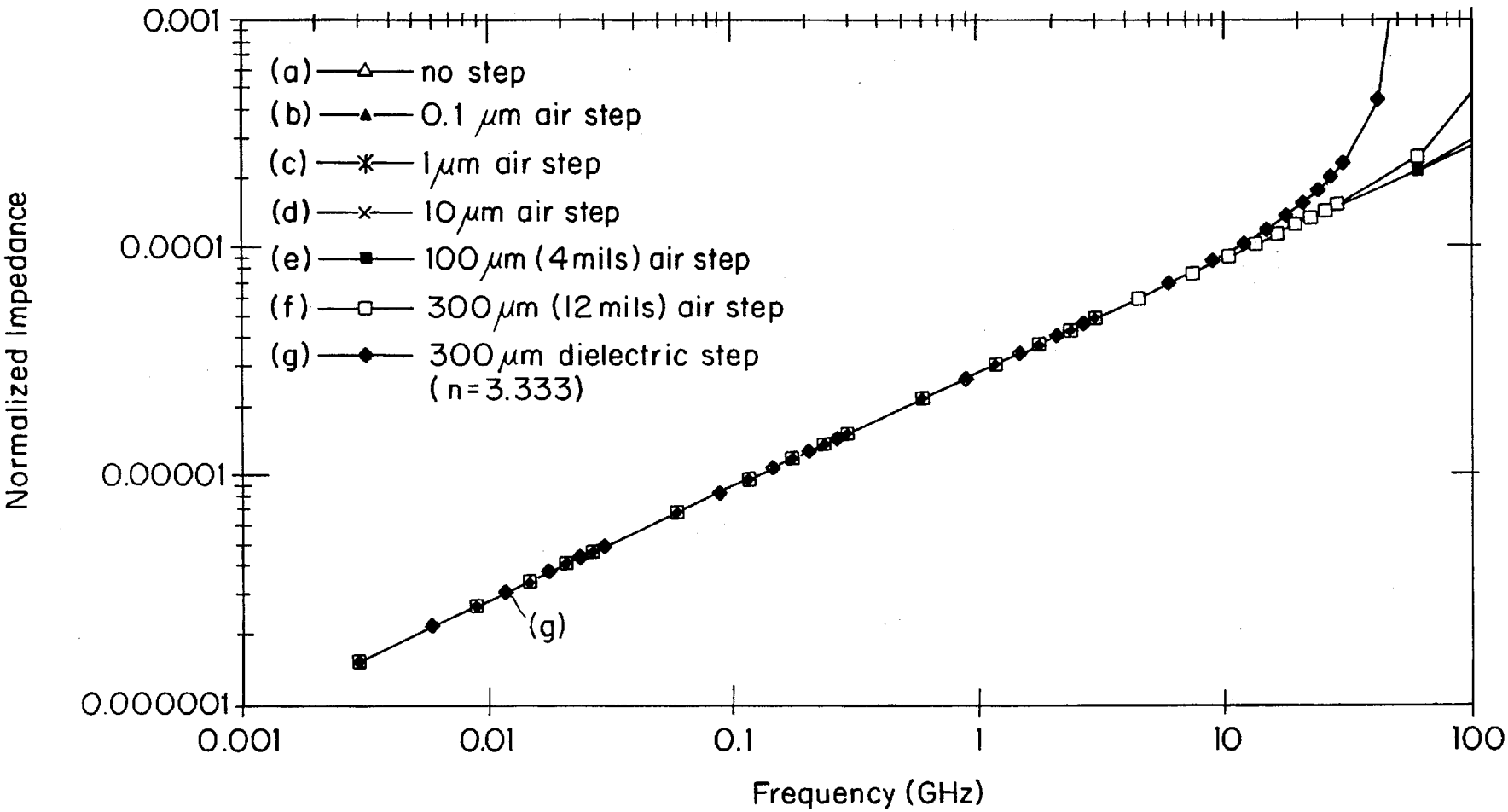
FIG. 4 is a plot of the real part of the surface impedance of aluminum with various thickness step discontinuities at an angle of incidence of 0 degrees from the normal.
Figure 5:
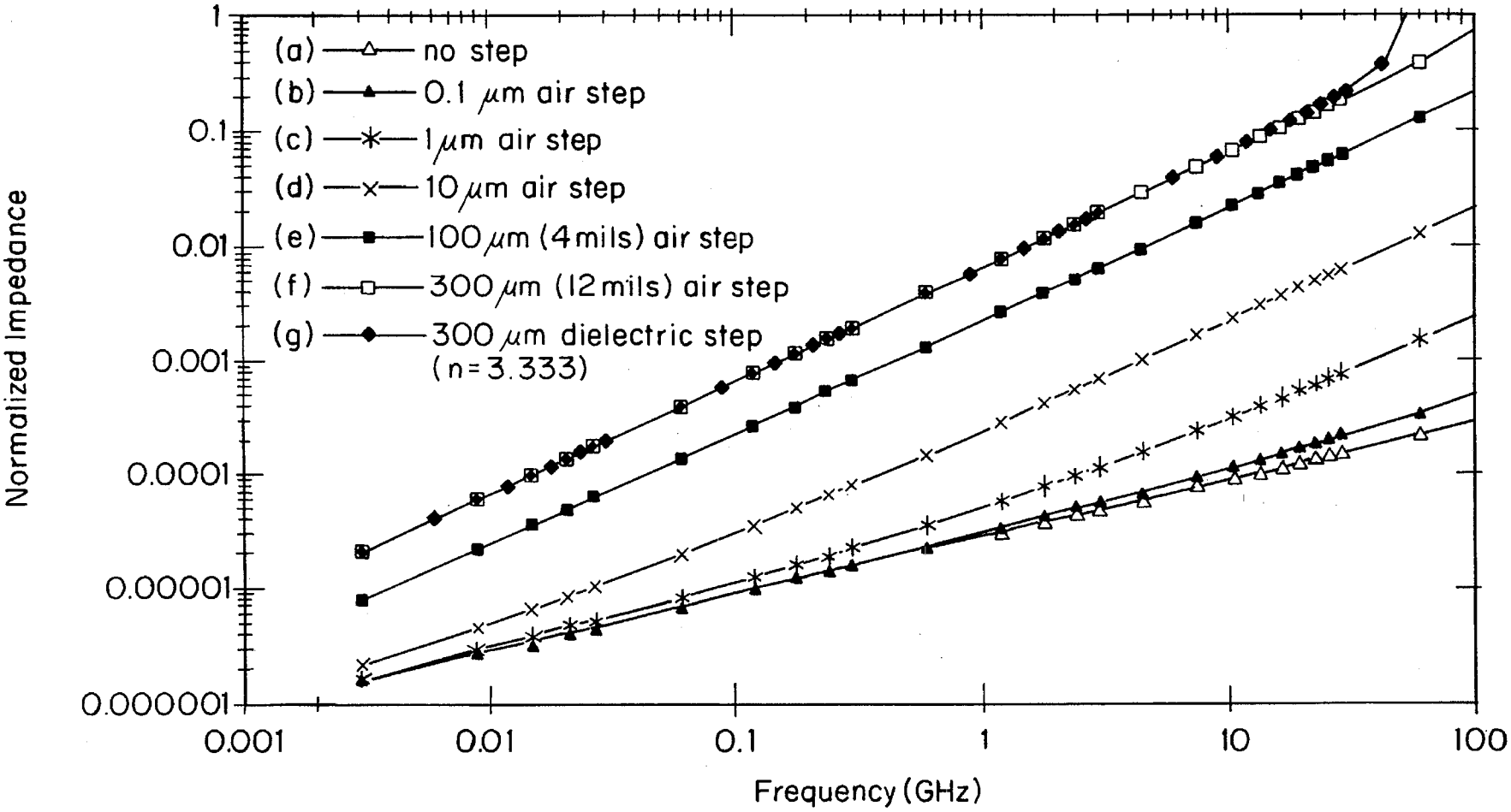
FIG. 5 is a plot of the imaginary part of the surface impedance of aluminum with various thickness step discontinuities at an angle of incidence of 0 degrees from the normal.

The real and imaginary parts of the surface impedances of 0.4 inch thick 1 Ω-cm silicon and 0.4 inch thick aluminum are compared in FIGS. 2 and 3 when the surfaces of the two materials are at the same height. A large difference between the real and imaginary parts of the surface impedances of the two materials is seen. The metal surface has a considerably lower surface impedance than the silicon. When layers of various thicknesses of air or any other dielectric material are introduced over the material with the lower surface impedance, the real part of the surface impedance is unchanged over most of the frequency range, while the imaginary part of the surface impedance increases. By tuning the thickness of the overcoat layer (in this example air) properly, the imaginary parts of the surface impedances can be matched at least one frequency. This is shown in FIGS. 4 and 5 for the aluminum and silicon case. In the example of FIG. 1C, when a 300 μm air step discontinuity is introduced over the aluminum 12 (see curve (f) FIG. 4) and curve (f) FIG. 5), the imaginary parts of the aluminum (curve (f) FIG. 5) and silicon (curve (a) FIG. 3) are well matched over a fairly broad frequency range near 10 Ghz.

When air is not used as the overcoat layer, as in FIG. 1B, any overcoat material 16 would be suitable as long as the thickness of the overcoat is calculated by taking into account the complex dielectric constant and magnetic permeability of the material. In general, if the imaginary part of the dielectric constant is low and the real part is not too high, the thickness of the required air and dielectric overcoats are approximately equal when the optical thickness of the filled step is less than $\approx\lambda/8$. The ability to use a dielectric or other filler material to reduce the impedance discontinuity at material discontinuities ensures that aerodynamic properties and durability will be maintained while the scatter is reduced.

One advantage to the step discontinuity approach for scatter reduction is that it is broadband. That is, a reduction in the difference between impedance discontinuities at many frequencies occurs, when the impedance discontinuity at any frequency is reduced.

Examples of media interfaces for which the invention would be particularly suitable, are (without limitation) the following: silicon/aluminum; conductively coated glass or plastic/aluminum; semiconductor/conductor; fabric/metal; mesh/conductor; composite/metal; and Radar absorbing material/metal. Note also that multilayered structures are contemplated herein, in which case, the complex impedance characteristics need to be included in calculation. Such calculations can be made in accordance with the teachings of the MacLeod reference previously cited.

The scatter reduction method of the invention is applicable to EM frequencies, in general, and is primarily intended for radio frequency application, microwaves, and radar frequencies in particular.

In addition to silicon and aluminum and other materials, such as, germanium, gallium arsenide, titanium, and beryllium may be used to form one or more of the layered structures.

Equivalents

Those skilled in the art will know, or be able to ascertain using no more than routine experimentation, many equivalents to the specific embodiments of the invention described herein.

These and all other equivalents are intended to be encompassed by the following claims.

What is claimed is:

1. A method of reducing scatter of electromagnetic radiation within a range of frequencies from objects, which scatter occurs at the interface between object media having different surface impedances, comprising the steps of: forming a step discontinuity at an interface, said step discontinuity having a height and containing a material, and selecting the height of the step and the composition of the material, such that the difference between imaginary parts of the surface impedance of the two media is minimized over the range of frequencies.

2. The method of claim 1 wherein the composition of the material in the step is a multilayered or single layer or inhomogeneous material selected from the group comprising solids, fluids, gases, and vacuum.

3. The method of claim 1 wherein the media are multilayered, single layer, or inhomogeneous material selected from the group comprising: semiconductors, metals, magnetic materials, meshes, conductively coated dielectrics, plastics, or crystals, conductors and dielectrics.

4. The method of claim 1 wherein one of the media is material from the group comprising silicon, Germanium, or Gallium Arsenide and the other from the group comprising aluminum, titanium, or beryllium and the material is air.

5. A method of reducing scatter of electromagnetic energy within a range of frequencies, said scatter caused by impedance discontinuities which occur at the interface between two media having different surface impedances, comprising the steps of:

a) forming a step discontinuity in the medium having the lower surface impedance;

b) providing a material in the discontinuity having a thickness and material composition which minimizes the difference between the imaginary parts of the surface impedances of the two media over said range of frequencies.

6. The method of claim 5 wherein forming a step discontinuity comprises lowering the outer surface of the medium with the lower surface impedance with respect to the medium having the higher surface impedance.

7. The method of claim 5 wherein the material is selected from the group comprising air or vacuum.

8. The method of claim 5 wherein the material is selected from the group comprising silicon, germanium, gallium arsenide, glass, spinel, plastics, or sapphire.

9. The method of claim 5 wherein the material is taken from the group comprising paint, radar absorbers, polyurethane, or rain erosion coatings.

10. The method of claim 5 wherein the material is multilayered.

11. Apparatus comprising:

An object having two mediums which meet at an interface; a first medium having a different surface impedance than the second medium, a step discontinuity formed in the medium having the lower surface impedance, the step discontinuity being formed of material;

the thickness and the composition of the material being selected to minimize the difference between the imaginary parts of the surface impedances of the two mediums.

12. The apparatus of claim 11 wherein the object is one or more of the group comprising vehicles, antennas, receivers, or transmitters.

13. The apparatus of claim 12 wherein the two mediums are comprised of multilayered or single layered materials from the group comprising semiconductors, conductors, metals, magnetic materials, meshes, conductively coated dielectrics, plastics or crystals and dielectrics.

14. The apparatus of claim 11 wherein the material is taken from the group comprising solids, fluids, gases and vacuum.

15. The apparatus of claim 11 wherein the material is air or vacuum.

16. A method of reducing scatter of electromagnetic radiation within a range of frequencies from objects, which scatter occurs at an interface between at least two mediums having different surface impedances, comprising the steps of: forming a step discontinuity at said interface, said step discontinuity having a height and containing a material, and selecting the height of the step and the composition of the material, such that the difference between imaginary parts of the surface impedance of the two mediums is minimized over the range of frequencies and wherein one of the media is material from the group comprising silicon, germanium, or gallium arsenide and the other from the group comprising aluminum, titanium, or beryllium and the material is air.

17. A method of reducing scatter of electromagnetic energy within a range of frequencies, said scatter caused by impedance discontinuities which occur at the interface between two media having different surface impedances, comprising the steps of:

a) forming a step discontinuity in the medium having the lower surface impedance;

b) providing a material in the discontinuity having a thickness and material composition which minimizes the difference between the imaginary parts of the surface impedances of the two media over said range of frequencies wherein the material is selected from the group comprising silicon, germanium, gallium arsenide, glass, spinel, plastics, or sapphire.

18. A method of reducing scatter of electromagnetic energy within a range of frequencies, said scatter caused by impedance discontinuities which occur at the interface between two media having different surface impedances, comprising the steps of:

a) forming a step discontinuity in the medium having the lower surface impedance;

b) providing a material in the discontinuity having a thickness and material composition which minimizes the difference between the imaginary parts of the surface impedances of the two media over said range of frequencies wherein the material is taken from the group comprising paint, radar absorbers, polyurethane, or rain erosion coatings.

19. The method of claim 18 wherein the material is multilayered.

20. Apparatus comprising:

An object having two mediums which meet at an interface; a first medium having a different surface impedance than the second medium, a step discontinuity formed in the medium having the lower surface impedance, the step discontinuity being formed of material; the thickness and the composition of the material being selected to minimize the difference between the imaginary parts of the surface impedances of the two mediums and wherein the object is one or more of the group comprising vehicles, antennas, receivers, or transmitters.

21. The apparatus of claim 20 wherein the two mediums are comprised of multilayered or single layered materials from the group comprising semiconductors, conductors, metals, magnetic materials, meshes, conductively coated dielectrics, plastics or crystals and dielectrics.

22. The apparatus of claim 20 wherein the material is taken from the group comprising solids, fluids, gases and vacuum.

23. The apparatus of claim 20 wherein the material is air or vacuum.

24. The method of claim 16 wherein the composition of the material in the step is a multilayered or single layer or inhomogeneous material selected from the group comprising solids, fluids, gases, and vacuum.

25. The method of claim 16 wherein the media are multilayered, single layer, or inhomogeneous material selected from the group comprising: semiconductors, metals, magnetic materials, meshes, conductively coated dielectrics, plastics, or crystals, conductors and dielectrics.

26. The method of claim 17 wherein forming a step discontinuity comprises lowering the outer surface of the medium with the lower surface impedance with respect to the medium having the higher surface impedance.

27. The method of claim 17 wherein the material is selected from the group comprising air or vacuum.

* * * * *